US007377611B2

(12) United States Patent
Shimoyama

(10) Patent No.: US 7,377,611 B2
(45) Date of Patent: May 27, 2008

(54) INK JET PRINTING APPARATUS AND PRELIMINARY EJECTING METHOD

(75) Inventor: Noboru Shimoyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/766,989

(22) Filed: Jan. 28, 2004

(65) Prior Publication Data

US 2004/0183847 A1 Sep. 23, 2004

(30) Foreign Application Priority Data

Jan. 31, 2003 (JP) ..... 2003-024916

(51) Int. Cl.
*B41J 29/38* (2006.01)

(52) U.S. Cl. ..... 347/16

(58) Field of Classification Search ..... 347/15, 347/20, 37, 101, 105, 16
See application file for complete search history.

(56) References Cited

U.S. PATENT DOCUMENTS 4,872,026 A * 10/1989 Rasmussen et al. ..... 347/56
6,364,446 B1 * 4/2002 Ishikawa et al. ..... 347/15
6,497,468 B1 * 12/2002 Otsuka ..... 347/16
6,659,580 B2 * 12/2003 Horikoshi ..... 347/9
6,714,748 B1 * 3/2004 Nakayasu et al. ..... 399/72
7,029,095 B2 * 4/2006 Tsuboi et al. ..... 347/35
2002/0054185 A1 * 5/2002 Kinoshita ..... 347/35

* cited by examiner

*Primary Examiner*—Julian D. Huffman
*Assistant Examiner*—Jason S. Uhlenhake
(74) *Attorney, Agent, or Firm*—Morgan & Finnegan, LLP

(57) ABSTRACT

The present invention provides an ink jet printing apparatus including feeding structure for feeding a print medium into the printing apparatus, conveying structure for conveying the print medium fed by the feeding structure to a position where printing head can carry out printing, and scanning structure for moving and scanning a carriage to a position where the printing head can be subjected to preliminary ejection, wherein a paper feeding and conveying operation is performed simultaneously with a preliminary ejecting operation of a print head, while not all of the feeding structure, conveying structure, and scanning structure are simultaneously driven. Therefore, by providing a power supply capacity sufficient to drive two of the three structures, it is possible to cause the print head to perform a preliminary ejecting operation without suspending the operation of feeding and conveying the print medium.

8 Claims, 6 Drawing Sheets

INK JET PRINTING APPARATUS AND PRELIMINARY EJECTING METHOD

This application claims priority from Japanese Patent Application No. 2003-024916 filed Jan. 31, 2003, which is incorporated hereinto by reference.

BACKGROUND OF THE INVENTION

1. Field of the Invention

The present invention relates to an ink jet printing apparatus that carries out printing using a print head based on an ink jet method, as an information output apparatus for outputting information from a personal computer or the like or in an image forming apparatus such as a copier or a facsimile machine.

2. Description of the Related Art

Ink jet printing apparatuses form an image by ejecting ink from a plurality of printing elements provided in a print head so that the ink impacts a print medium. The ink jet printing apparatus ejects a large number of small ink droplets the amount of which is small. Accordingly, depending on the contents of the ink or the usage of the print head, thermal decomposition may occur in a dye or pigment contained in the ink. As a result, immobilized ink may be deposited near ejection openings. If no action is taken for the deposition of such solids, the openings may be gradually blocked by the solids to disturb the direction or amount of ejections. Moreover, the printing element itself may become unable to eject ink. Images formed by the print head which has become unable to eject ink correctly undergo a non-uniform density or the presence of stripes. Such images thus have low quality.

Thus, the ink jet printing apparatus contains a recovery mechanism used for the maintenance of the print head. The recovery mechanism executes various maintenance processes. Common such processes include suction recovery that forcedly sucks a predetermined ink from the printing element in the print head, preliminary ejection that causes ejection from the printing element in the print head which ejection is not related to printing, and a wiping operation of using a wiper blade to clean an ejection surface in which the ejection openings are arranged. These processes are executed at proper points to keep the print head and outputted images reliable.

One of the maintenance processes is preliminary ejection carried out immediately before printing. In an unused printing element, an ink solvent is volatilized and a color material is correspondingly concentrated. This phenomenon becomes gradually serious over time. Thus, in order to efficiently reduce this phenomenon while minimizing the loss of time and ink, it is appropriate to carry out preliminary ejection immediately before printing to forcedly dispose of the concentrated ink. In general, this process is started at the same time when a command to start printing is given and is executed concurrently with an operation of feeding a print medium. This prevents the time required for the maintenance of the print head from affecting the time required for printing (that is, throughput).

However, for the recent ink jet printing apparatus, there have been growing demands for smaller sizes in view of space saving. Furthermore, arrangements focusing on portability have been desired. If attempts are made to achieve this, the following new problems arise.

A size reduction reduces the distance over which feeding means feeds one print medium from a position where print media are stacked into the printing apparatus main body after separating this medium from the others. Accordingly, a paper feeding operation can be completed in a shorter time. Printing throughput is thus expected to be further improved.

However, if a paper feeding operation and a preliminary ejection operation are performed concurrently, the throughput is not improved if only the time required for the paper feeding operation is reduced while the preliminary ejection operation requires a time longer than that required for the paper feeding operation. The throughput is limited by the time required for the preliminary ejection operation, which is not related directly to printing. In the prior art, a preliminary ejection sequence executed before printing is advantageous in that it ensures reliability without affecting the throughput in a series of printing operations from paper feeding to paper discharging. However, a smaller printing apparatus with a reduced paper feeding time does not give such an advantage based on the preliminary ejection sequence but conversely hinders the improvement of the throughput.

On the other hand, if focus is on a size reduction or portability, the capacity of a power source that can be mounted in the printing apparatus is also limited. If the capacity of the power source is reduced, it is difficult to simultaneously drive a number of driving sources. For example, the following motors are often driven at substantially the same time when printing is started: a carriage motor used to drive a carriage on which the print head is mounted and which moves for scanning, a conveying motor used to drive conveying means for conveying a print medium, and a feeding motor used to drive the feeding means for feeding a print medium to the conveying means. However, if the capacity of the power source is limited, these three motors may not be driven at exactly the same time. To cope with this, it is possible to execute a series of sequences while sequentially switching the driven motor at intervals of a short time. However, this method further reduces the throughput.

SUMMARY OF THE INVENTION

The present invention is provided to solve the above described problems. It is an object of the present invention to provide an ink jet printing apparatus that can perform a preliminary ejection operation immediately before printing without affecting the throughput even though it is smaller and has a reduced power supply capacity.

The term "print medium" as used herein refers not only to paper used in common ink jet printing apparatuses but also to a medium that can receive ink, such as a cloth, a film, or a metal plate.

Moreover, the term "ink" refers to a liquid that can be applied to a print medium to form an image, a design, or a pattern or to process the print medium.

In a first aspect of the present invention, there is provided An ink jet printing apparatus having carriage scanning means for moving and scanning a carriage on which a print head that ejects ink is mounted, print medium feeding means for feeding one of a plurality of stacked print media, and print medium conveying means for conveying the print medium fed by the print medium feeding means to a position where printing can be carried out using the print head, the apparatus comprising: control means for causing concurrent performance of a print medium feeding and conveying operation of continuously conveying the print medium while shifting the print medium from the print medium feeding means to the print medium conveying means and a preliminary ejecting operation of the print head, the control means providing control such that not all of driving of the print medium feeding means, driving of the print medium conveying means, and the preliminary ejecting operation are simultaneously performed.

In a second aspect of the present invention, there is provided a preliminary ejecting method comprising: a first step of moving a carriage on which a print head that ejects ink is mounted, to a position where preliminary ejection can be carried out; a second step of allowing the print head to carry out preliminary ejection; a third step of moving the carriage to a position where the print head can execute printing on a print medium; a fourth step of feeding one of a plurality of stacked print media; and a fifth step of conveying the print medium fed by the fourth step to a position where printing can be carried out using the print head, and wherein three or more of the first to fifth steps are not simultaneously executed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be specifically described with reference to the drawings.

Figure 1:
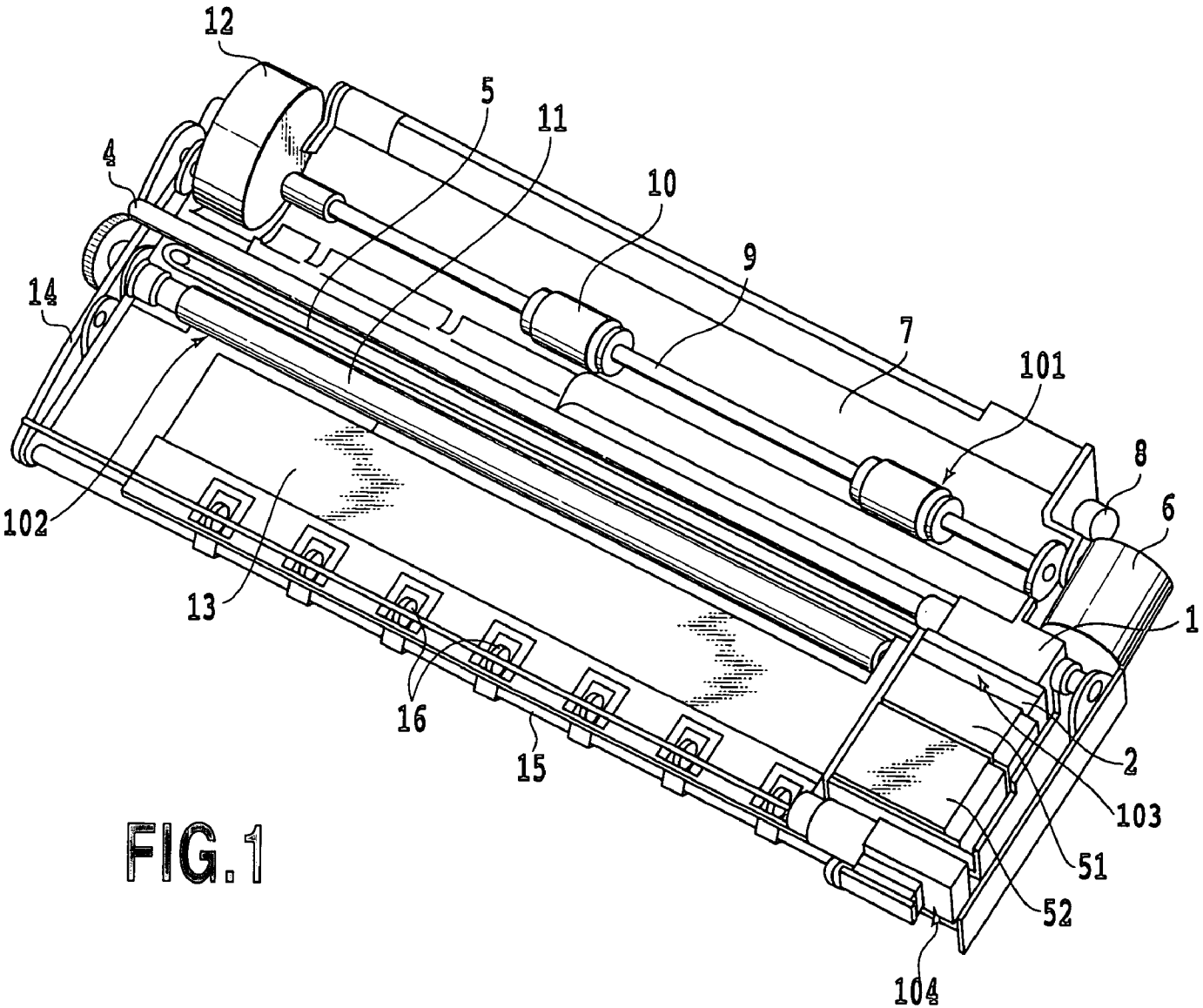
FIG. 1 is a schematic perspective view showing the internal configuration of an ink jet printing apparatus applied in an embodiment of the present invention.

FIG. 1 is a perspective view showing an ink jet printing apparatus that is applicable to the present invention. Reference numeral 101 denotes print medium feeding means for feeding a plurality of stacked print media to the printing apparatus main body one by one. Reference numeral 102 denotes print medium conveying means for sequentially conveying the print media provided in the main body as printing progresses. Reference numeral 103 denotes printing means for executing printing on the print medium. Reference numeral 104 denotes recovery means for the maintenance of the printing means.

The print medium feeding means 101 is composed of a feeding plate 7, a feeding motor 8, a feeding roller 9, a feeding roller rubber 10, and the like. Before printing, a plurality of print media is stacked on the feeding plate 7. When printing is started, the feeding roller rubber 10, provided around the periphery of the feeding roller 9, is pressed into contact with the surface of the uppermost print medium P (not shown in FIG. 1). This enables the push-out (feeding) of only the uppermost one P of the stacked print media. Subsequently, the feeding motor 8 drives and rotates the feeding roller 9 to feed the print medium P up to the conveying means 102.

The print medium P fed to the conveying means 102 is then fed to the platen 13 by the conveying roller 11, driven by the conveying motor 12. The above paper feeding and conveying operations are performed before printing.

The printing means 103 is composed of a carriage 1, a print head 2, a guide shaft 4, a carriage belt 5, a carriage motor 6, ink tanks 51 and 52, and the like. The print head 2 and the ink tanks 51 and 52, which supply ink to the print head 2, are mounted on the carriage 1. As the carriage 1 reciprocates, the print head 2 ejects ink using proper timings to form an image on the print medium P arranged on the platen 13. The scanning movement of the carriage 1 is carried out by transmitting the driving force of the carriage motor 6 to the carriage belt 5. The moving direction is limited to one along the guide shaft 4. Accordingly, with the ink jet printing apparatus according to the present embodiment, images are sequentially formed on the print medium P by alternately repeating a printing operation of the print head 2 performed synchronously with the reciprocation (main scanning) of the carriage 1, and the conveyance of the print medium P by a predetermined amount (sub scanning).

The completely printed print medium P is fed out to the paper discharging roller 15 by the feeding roller 11. The print medium P is then discharged while being sandwiched between the paper feeding roller 15 and spurs 16.

The driving by the conveying motor 12 is transmitted to the paper discharging roller 15 via the paper discharging belt 14. The paper discharging roller 15 is drivingly rotated simultaneously with the conveying roller 11. In this case, the peripheral speed (conveying speed) of the paper discharging roller 15 is set to be slightly higher than that of the conveying roller 11. Accordingly, appropriate tension is applied to the print medium P during printing.

The recovery means 104 eliminates the blockage of the print head 2 with ink or the like to maintain or recover the normal grade of printing. The recovery means 104 is composed of pump means (not shown) for causing ink to be sucked or ejected from ejection openings in the print head 2, cap means (not shown) for covering the ejection openings, wiping means (not shown) for wiping and cleaning an ejection opening surface, and the like.

Figure 2:
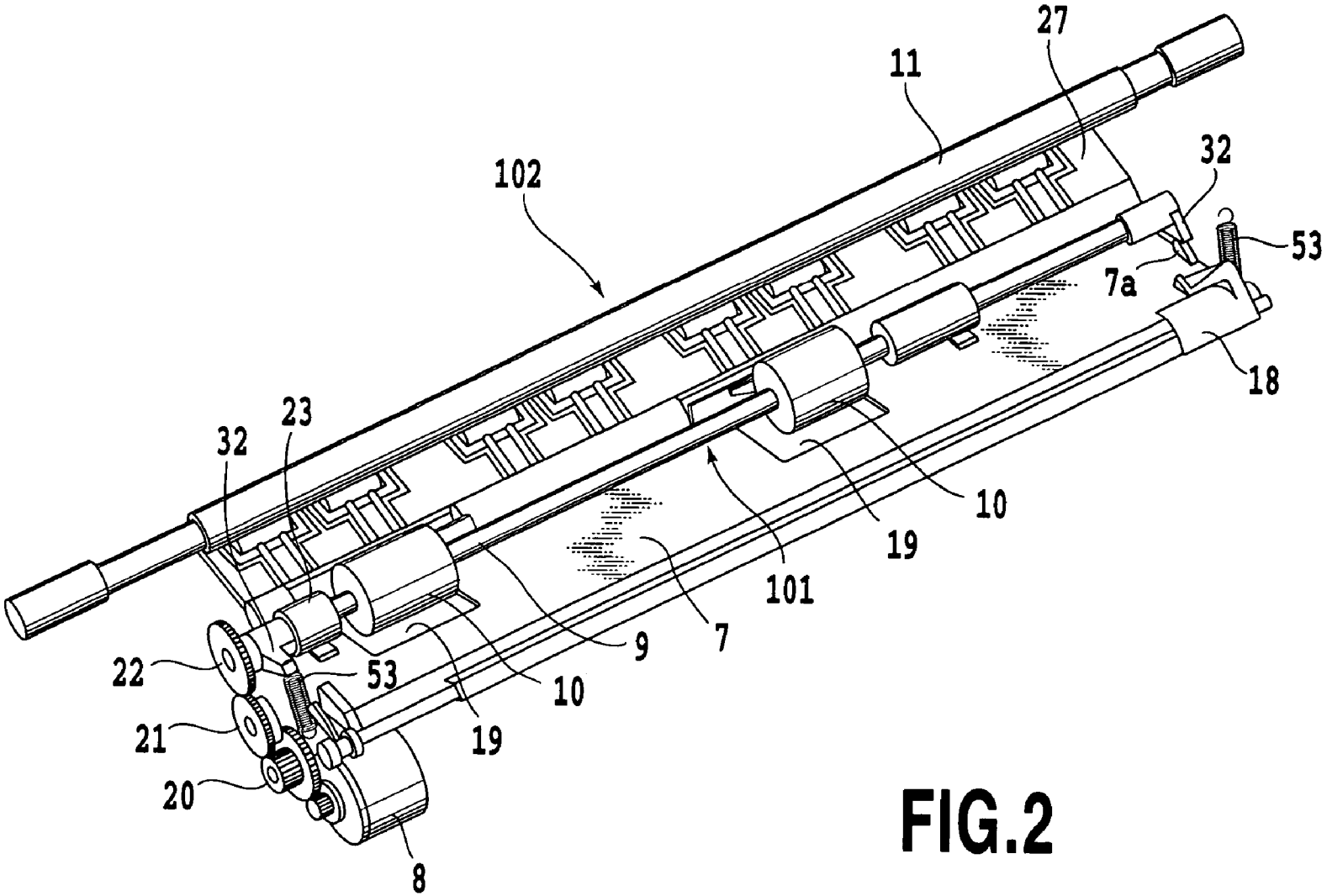
FIG. 2 is a schematic perspective view showing the configuration of feeding means of the ink jet printing apparatus applied in the embodiment of the present invention.

FIG. 2 is a schematic perspective view useful in describing the configuration of the print medium feeding means 101 and conveying means 102 in detail.

In FIG. 2, reference numerals 20 and 21 denote idle gears, and reference numeral 22 denotes a feeding roller gear. The driving force of the feeding motor 8 is transmitted to the feeding roller 9 via the idle gears 20 and 21 and feeding roller gear 22, to rotate the feeding roller 9. The feeding roller 9 is rotatably supported via a bearing 23 in a chassis (not shown) in the printing apparatus main body.

The print medium P stacked on the feeding plate 7 is positioned by a paper guide 18. The feeding plate 7 is urged toward the feeding roller 9 by platen springs 53 locked to the respective sides of the feeding plate 7.

Projecting portions (cam following portions) 7*a* integrated with the feeding plate 7 are provided on the respective sides of the feeding plate 7. On the other hand, feeding roller cams 32 rotating integrally with the feeding roller 9 are installed on the respective sides of the feeding roller 9. Each projecting portion 7*a* and the corresponding feeding roller cam 32 are configured to abut against each other using predetermined timings. When the feeding roller cam 32 rotates together with the feeding roller 9, the feeding roller cam 32 and the projecting portion 7*a* are separated from and abutted against each other using the predetermined timings. Accordingly, the feeding roller rubber 10 abuts against and separates from the print medium P on the feeding plate 7 using the predetermined timings. The predetermined timings as used herein are related to the performance of a paper feeding operation. During a feeding operation of feeding the print medium P, the platen 7 is abutted against the feeding roller 9. After the print medium P has been completely fed, or during operations other than paper feeding, the feeding plate 7 is separated from the feeding roller 9.

Moreover, areas of the platen 7 which are opposite the feeding roller rubber 10 on the feeding roller 9 are provided with separation sheets 19 used to exert a relatively strong frictional force between them and the print medium P. The separation sheets 19 serve to exert a frictional force between the print medium P and the platen 7 to prevent the feeding of a number of print media P during a feeding operation.

Figure 3:
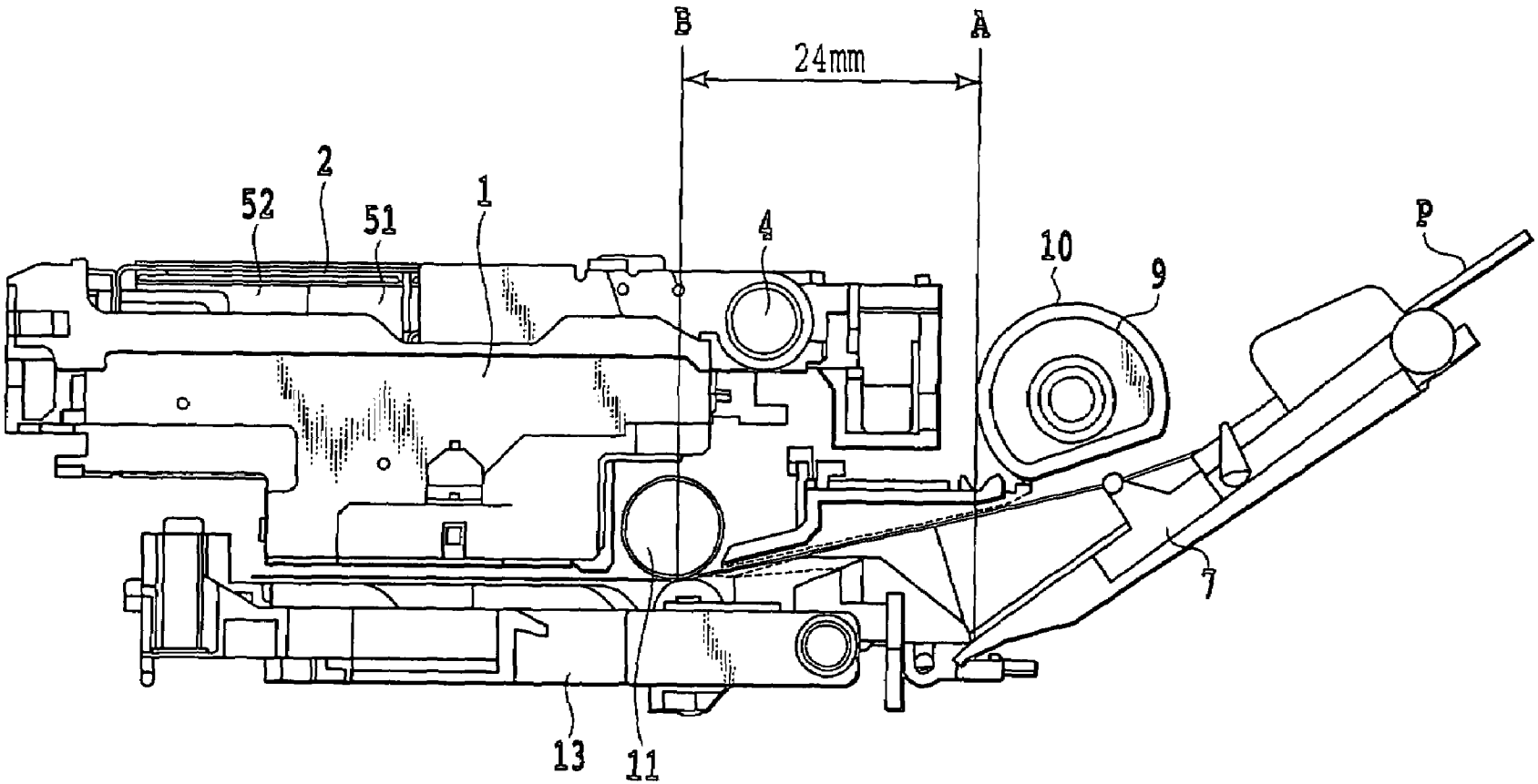
FIG. 3 is a schematic side view showing the internal configuration of the ink jet printing apparatus applied in the embodiment of the present invention.

FIG. 3 is a schematic side view of the ink jet printing apparatus applicable to the present invention. As shown in FIG. 3, in the ink jet printing apparatus applied in the present embodiment, the distance between a point A at a leading end portion of the print medium P stacked on the platen 7 and positioned by the paper guide 18 and a point B at the conveying roller 11 is 24 mm. During a feeding operation performed by the print medium feeding means 101, the leading end portion of the print medium P moves 24 mm.

Figure 4:
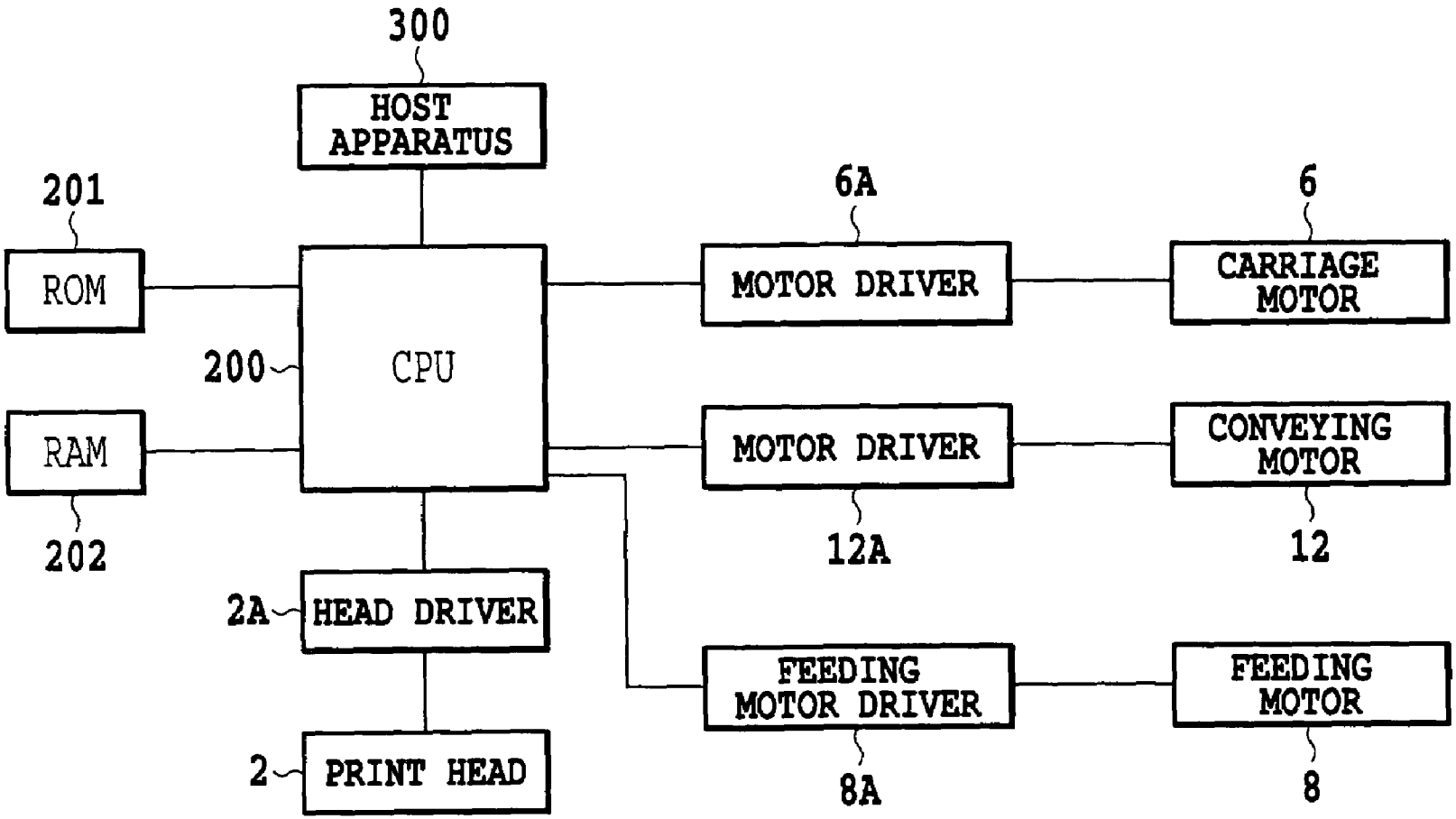
FIG. 4 is a block diagram illustrating the configuration of a control system of the ink jet printing apparatus applied in the embodiment of the present invention.

FIG. 4 is a schematic block diagram showing the configuration of a control system of the ink jet printing apparatus to which the present invention is applicable. In FIG. 4, a CPU 200 controls operations of the printing apparatus applied in the present embodiment and executes data processing and the like. A ROM 201 stores programs for, for example, process procedures executed by the CPU 200. A RAM 202 is used as a work area in which these processes are executed.

Ink is ejected from the print head 2 by the CPU 200 by supplying a head driver 2A with data (image data) on the driving of a printing element. The CPU 200 controls the carriage motor 6, used to drive the carriage 1 in a main scanning direction. The CPU 200 also controls the conveying motor 12 via a motor driver 12A, which motor is used to convey the print medium P in a sub-scanning direction. The CPU 200 further controls the feeding motor 8 via a motor driver 8A, which motor is used to feed the print medium P to the conveying roller 11.

Reference numeral 300 denotes a host apparatus such as a personal computer which is connected to the printing apparatus. An application forming an image recorded by a user, a printer driver that can set a print mode, and the like are installed in the host apparatus 300.

Figure 5:
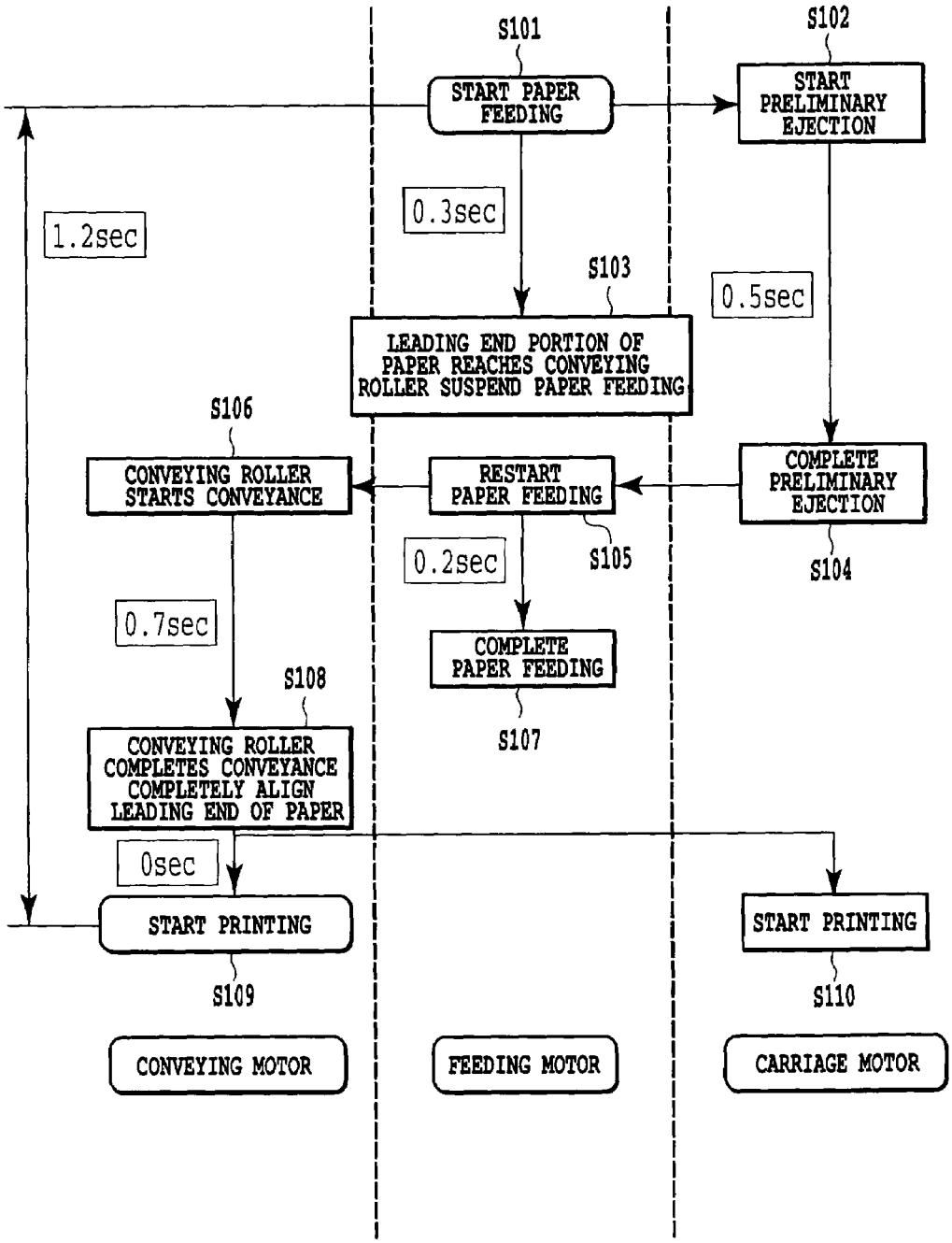
FIG. 5 is a diagram showing a paper feeding sequence according to a conventional method.

FIG. 5 is a diagram showing a sequence from the start of paper feeding to the start of printing carried out by the CPU 200 in accordance with a conventional method when the host apparatus 300 gives a command to start printing.

In FIG. 5, the vertical direction indicates the passage of time. The horizontal direction indicates three areas corresponding to the conveying motor 12, feeding motor 8, and carriage motor 6. This figure makes it easy to determine which of the three motors is used for driving in each step of the sequence.

When a command to start printing is inputted, the feeding motor 8 first starts feeding a print medium (S101). At the same time, the carriage motor 6 moves the carriage 1 to a capping position that allows the print head 2 to carry out preliminary ejection. The print head 2 then starts preliminary ejection (S102). The preliminary ejection requires 0.5 seconds.

On the other hand, the leading end portion of the print medium P reaches the conveying roller 11 0.3 seconds after paper feeding is started using the feeding motor 8. That is, since the ink jet printing apparatus of the present embodiment is smaller than conventional ones as shown in FIG. 3, the above distance is about 24 mm, thus allowing the movement to be completed in 0.3 seconds. In this case, to feed the print medium P to the position of the platen 13, the feeding motor 6 and the conveying motor 12 must be simultaneously caused to carry out driving. However, at this point, the preliminary ejecting operation has not been completed. Accordingly, since the printing apparatus of the present embodiment does not have a sufficient power supply capacity to simultaneously cause the three motors to carry out driving, the conveying operation can no longer be progressed. Thus, paper feeding is suspended (S103). Then, the apparatus is brought into a standby state for 0.3 seconds until the preliminary ejecting operation is completed.

When preliminary ejection is completed at S104, the feeding motor resumes driving (S105). The print medium P is then conveyed to the position of the platen 13. This conveyance requires 0.2 seconds. Then, the paper feeding and conveying operation is completed (S107). Furthermore, at the same time when preliminary ejection is completed (S104), the conveying roller 12 starts conveying the print medium P (S106). The print medium P is conveyed in accordance with the magnitude of positioning of the leading end. Even if the magnitude of positioning of the leading end is smallest, that is, the conveying distance is shortest, 0.7 seconds is required to covey the print medium so as to align its leading end. One the leading end is completely aligned, the paper feeding and conveying operation is finished (S108). Then, at the same time, actual printing is started. That is, the following operations are alternately performed: a step of conveying the carriage while allowing the print head 2 to eject ink (S110) and a step of allowing the conveying motor 12 to convey the print medium (S109).

In the above sequence, 1.2 seconds is required to complete the paper feeding operation at S108, from operation being started at S101.

Figure 6:
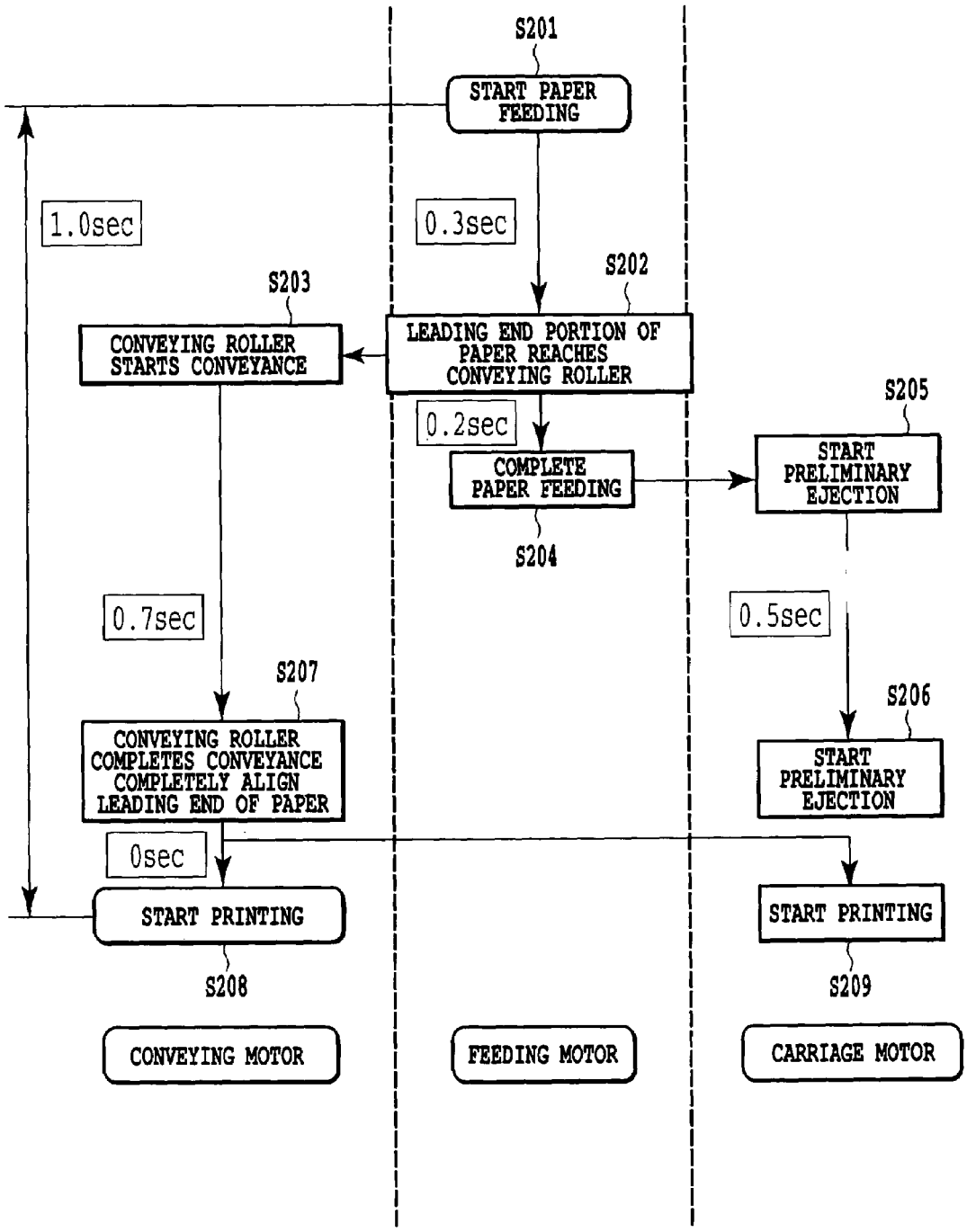
FIG. 6 is a diagram showing a paper feeding sequence according to the embodiment of the present invention.

FIG. 6 is a diagram illustrating, in comparison with FIG. 5, a sequence from the start of paper feeding to the start of printing carried out by the CPU 200 in accordance with the present method when the host apparatus 300 gives a command to start printing.

In the present embodiment, when a command to start printing is inputted, the feeding motor 8 first starts feeding a print medium (S201). Then, 0.3 seconds after paper feeding has been started, the leading end portion of the print medium P reaches the conveying roller 11 (S202).

Subsequently, the paper feeding motor 6 and the conveying motor 12 are simultaneously caused to carry out driving to convey the print medium P to the position of the platen 13. This conveyance requires 0.2 seconds (S204).

The driving by the feeding motor 8 is completed at S204. However, the conveying motor 12 subsequently performs an operation of aligning the leading end of the print medium P. The operation of aligning the leading end requires 0.7 seconds at minimum as in the case of FIG. 5.

On the other hand, once the paper feeding operation is completed, the carriage motor 6 moves the carriage 1 to the capping position. The print head 2 then starts preliminary ejection (S205). The preliminary ejection requires 0.5 seconds.

The alignment of the leading end by the conveying motor 12 is completed almost simultaneously with the preliminary ejecting operation (S207 and S206).

At this point, the paper feeding and conveying sequence is completed. At the same time, actual printing is started. That is, the following operations are alternately performed: a step of conveying the carriage while allowing the print head 2 to eject ink (S209) and a step of allowing the conveying motor 12 to convey the print medium (S208).

In the above sequence, 1.0 seconds is required from the operation being started at S201 to complete the paper feeding and conveying operation and followed by printing at S208. In contrast to the application of the conventional method described in FIG. 5, the time has decreased by 0.2 seconds.

According to the conventional method, simultaneously with a command to start printing, the feeding of the print medium P and preliminary ejection from the print head are started at the same time. Thus, during a series of steps in which the conveyance of the print medium shifts from the feeding roller to the conveying roller, the three motors must be simultaneously caused to carry out driving. Of course, even in such a situation, no problems occur if the printing apparatus is relatively large and has a large power supply capacity. However, for a small printing apparatus focusing on portability as in the case of the present embodiment, a power source with a reduced capacity must be applied. In this case, it is impossible to simultaneously cause a large number of motors to carry out driving. That is, in order to minimize the loss of throughput while effectively using the limited power supply, it is important to efficiently set the order in which the plurality of motors are operated.

Through examinations in view of such a situation, the inventors have found that in the series of steps in which the conveyance of the print medium shifts from the feeding roller to the conveying roller, a latter stage involving only the conveying roller requires a longer time than an initial stage involving the feeding roller. The preliminary ejecting operation itself is not related directly to the paper feeding and conveying operation. The preliminary ejecting operation has only to be performed at any point during the paper feeding and conveying operation and completed during this operation. Thus, in the present embodiment, the preliminary ejecting operation is shifted to the latter stage involving only the conveying roller. Therefore, the paper feeding operation is successfully completed in the shortest time while avoiding causing simultaneously the three motors to carry out driving.

In the above embodiment, for simplification, the three driving sources, that is, the feeding motor 8, the conveying motor 12, and the carriage motor 6 have been described. However, in an actual preliminary ejecting operation, a head driver 10A is also used for driving in order to cause the print head 2 to preliminarily eject ink. Thus, in FIGS. 5 and 6, timings for driving the head driver 2A must essentially be taken into account. However, in an actual preliminary ejecting operation, the step of moving the carriage 1 and the step of causing the print head 2 to preliminarily eject ink are not exactly simultaneously executed. That is, the drivers driving the carriage 1 and the print head 2, respectively, are switched at small intervals to complete all the steps during 0.5 seconds from start to completion of preliminary ejection. The details of these operations are omitted in FIGS. 5 and 6.

As described above, according to the present invention, by providing a power supply capacity sufficient to drive two of the three means, that is, the print medium feeding means, print medium conveying means, and carriage scanning means, it is possible to cause the print head to perform a preliminary ejecting operation without suspending an operation of feeding and conveying a print medium. This enables the performance of a paper feeding and conveying operation and preliminary ejecting operation that are efficient in throughput and power supply capacity.

The present invention has been described in detail with respect to preferred embodiments, and it will now be apparent from the foregoing to those skilled in the art that changes and modifications maybe made without departing from the invention in its broader aspects, and it is the intention, therefore, in the appended claims to cover all such changes and modifications as fall within the true spirit of the invention.

What is claimed is:

1. An ink jet printing apparatus having carriage scanning means for moving and scanning a carriage on which a print head that ejects ink is mounted, print medium feeding means for feeding one of a plurality of stacked print media, which feeds the print medium so that the print medium reaches to a print medium conveying means which is in a resting state, and said print medium conveying means for conveying said print medium fed by said print medium feeding means to a position where printing can be carried out using said print head, the apparatus comprising:

preliminary ejection performing means that causes the print head to eject ink at a capping position, the ejecting ink at the capping position being not related to printing; and control means for, before printing to the print medium which has not been printed yet, causing said print medium feeding means and said print medium conveying means to perform a print medium feeding and conveying operation in which said print medium is conveyed continuously while shifting said print medium from said print medium feeding means to said print medium conveying means and causing in parallel, performance of a preliminary ejecting operation by said preliminary ejection performing means during a part of the period of the performance of the print medium feeding and conveying operation, wherein there is an overlapping period in which said print medium feeding means and said print medium conveying means are driven simultaneously, and said control means controls such that said preliminary ejecting operation is not performed in the overlapping period.

2. An ink jet printing apparatus as claimed in claim 1, wherein said preliminary ejecting operation is performed concurrently with said operation performed by said print medium conveying means to convey said print medium the position where printing can be carried out using said print head, said conveying operation being included in said print medium feeding and conveying operation.

3. An ink jet printing apparatus as claimed in claim 1, wherein said ink jet printing apparatus has a first driving source that electrically drives said carriage scanning means, a second driving source that electrically drives said print medium feeding means, and a third driving source that electrically drives said print medium conveying means, and not all of said three driving sources are simultaneously driven.

4. An ink jet printing apparatus as claimed in claim 1, wherein said control means controls such that said preliminary ejecting operation is started after said driving of said print medium feeding means has completed.

5. The ink jet printing apparatus according to claim 1, wherein said preliminary ejection performing means, before the ejection, moves the print head to the capping position which is located in a recovery means out of a printing region.

6. The ink jet printing apparatus according to claim 1, wherein a time for the preliminary ejection operation is shorter than a time from when said print medium conveying means starts conveying the print medium until when the print medium reaches to the position where printing can be carried out, and is longer than a time from when said print medium feeding means starts feeding the print medium until when the print medium reaches to said print medium conveying means.

7. A control method of an ink jet printing apparatus having carriage scanning means for moving and scanning a carriage on which a print head that ejects ink is mounted, print medium feeding means for feeding one of a plurality of stacked print media, which feeds the print medium so that the print medium reaches to a print medium conveying means which is in a resting state, said print medium conveying means for conveying said print medium fed by said print medium feeding means to a position where printing can be carried out using said print head, and preliminary ejection performing means that causes the print head to eject ink at a capping position, the ejecting ink at the capping position being not related to printing; the control method comprising:

a step of controlling, before printing to the print medium which has not been printed yet, for causing said print medium feeding means and said print medium conveying means to perform a print medium feeding and conveying operation in which said print medium is conveyed continuously while shifting said print medium from said print medium feeding means to said print medium conveying means, and causing in parallel, performance of a preliminary ejecting operation by said preliminary ejecting performing means during a part of the period of the performance of the print medium feeding and conveying operation;

wherein there is an overlapping period in which said print medium feeding means and said print medium conveying means are driven simultaneously, and said controlling step controls such that said preliminary ejecting operation is not performed in the overlapping period.

8. An ink jet printing apparatus having carriage scanning means for moving and scanning a carriage on which a print head that ejects ink is mounted, feeding means for feeding one of a plurality of stacked print media, which feeds the print medium so that the print medium reaches to a print medium conveying means which is in a resting state, and conveying means for conveying said print medium fed by said feeding means to a position where printing can be carried out using said print head, the apparatus comprising:

preliminary ejection performing means that causes the print head to eject ink at a capping position, the ejecting ink at the capping position being not related to printing; and control means for controlling a preliminary ejecting operation to be performed by said preliminary ejection performing means after a print medium feeding operation by said feeding means has completed, for controlling a print medium conveying operation by said conveying means to be started at the timing at which the print medium is fed to a predetermined position before said print medium feeding operation has completed, and for controlling a printing operation using said print head to be started after said print medium conveying operation and said preliminary ejecting operation have completed, wherein between the timing at which the print medium is fed to said predetermined position and a timing at which said print medium feeding operation is completed, said print medium feeding operation and said print medium conveying operation are performed in parallel with each other, and after said print medium feeding operation is completed, said print medium conveying operation and said preliminary ejecting operation are performed in parallel with each other.

* * * * *